US005409599A

United States Patent [19]

Harandi

[11] Patent Number: 5,409,599

[45] Date of Patent: Apr. 25, 1995

[54] PRODUCTION OF LOW SULFUR DISTILLATE FUEL

[75] Inventor: Mohsen N. Harandi, Langhorne, Pa.

[73] Assignee: Mobil Oil Corporation, Fairfax, Va.

[21] Appl. No.: 293,775

[22] Filed: Aug. 22, 1994

Related U.S. Application Data

[63] Continuation of Ser. No. 973,508, Nov. 9, 1992, abandoned.

[51] Int. Cl.[6] ..... C10G 45/00; C10G 65/02

[52] U.S. Cl. ..... 208/210; 208/58

[58] Field of Search ..... 208/58, 210, 59, 60, 208/211

[56] References Cited

U.S. PATENT DOCUMENTS

| | | | |
|---|---|---|---|
| 3,617,526 | 11/1971 | Coons, Jr. et al. | 208/210 |
| 4,302,323 | 11/1981 | Chen | 208/89 |
| 4,738,766 | 4/1988 | Fischer et al. | 208/68 |
| 4,990,242 | 2/1991 | Louie et al. | 208/211 |
| 5,011,593 | 4/1991 | Ware et al. | 208/213 |

OTHER PUBLICATIONS

Gates, McGraw-Hill, pp. 390–411 and 443–445 Chemistry of Catalytic Processes Amos et al. pp. 93–100 Hydrocarbon Processing Jun. 1992.

*Primary Examiner*—Anthony McFarlane
*Assistant Examiner*—Bekir L. Yildirim
*Attorney, Agent, or Firm*—A. J. McKillop; M. D. Keen

[57] ABSTRACT

Low sulfur distillate fuel oils such as road diesel oil having a maximum sulfur content of 0.05 weight percent, are produced by segregation of a distillate range feed into a lower boiling fraction and higher boiling fraction with the cut point between the two fractions between about 600° and 650° F. (about 315° to 345° C.). The higher boiling fraction is hydrodesulfurized under relatively severe conditions and then combined with the lower boiling fraction to be hydrodesulfurized under less severe conditions. Operation in this manner enables the refractory dibenzothiophenes to be removed while maintaining a lower hydrogen consumption.

7 Claims, 1 Drawing Sheet

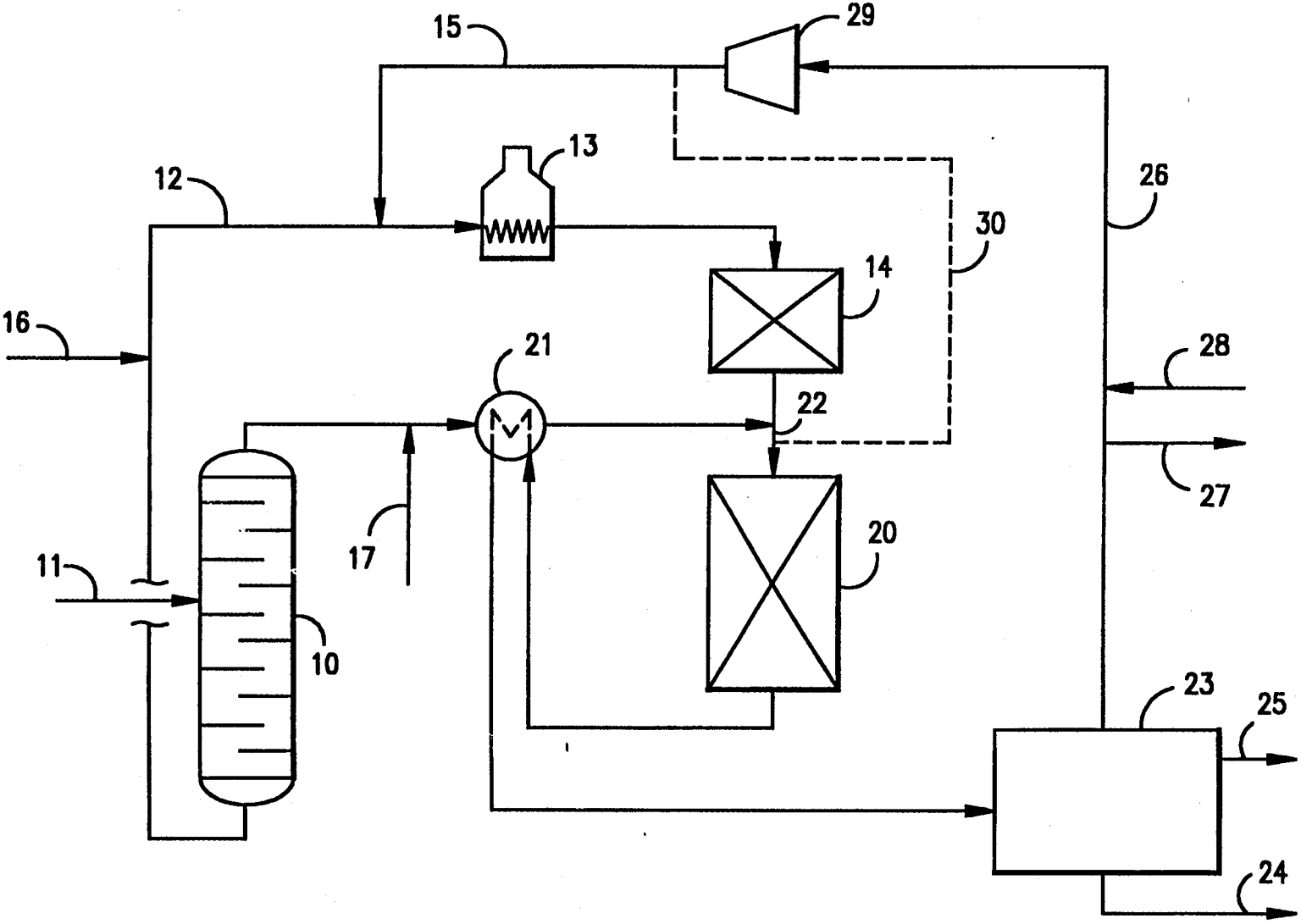
10
11
12
13
14
15
16
17
20
21
22
23
24
25
26
27
28
29
30

PRODUCTION OF LOW SULFUR DISTILLATE FUEL

This application is a continuation of application Ser. No. 07/973,508, filed Nov. 9, 1992, now abandoned.

1. Field of The Invention

This invention relates to a process for producing low sulfur distillates such as low sulfur road diesel fuel.

2. Background of the Invention

Environmental concerns are expected to lead to decreases in the permissible levels of sulfur in hydrocarbon fuels. At present, it is likely that the maximum sulfur level of road diesel oils will be reduced from about 0.3 weight percent to 0.05 weight percent. A reduction of this magnitude will have a significant effect on refinery operations in which diesel fuel is produced by the hydrodesulfurization of various refinery streams including catalytically cracked fractions such as FCC light cycle oil (LCO).

Sulfur is found in refinery streams in a number of different forms including aliphatic and aromatic sulfur compounds but tends to be concentrated in the higher boiling fractions, mainly in the form of aromatic heterocyclic compounds such as the thiophenes, benzothiophenes and dibenzothiophenes. Conventional hydrodesulfurization processes are capable of removing sulfur compounds, especially the lower molecular weight materials including the aliphatic sulfur materials, thiophenes and dibenzothiophenes. At higher desulfurization severities, the more refractory sulfur compounds can be removed although with increased cost and with greater difficulty. Certain sulfur compounds are more difficult to remove than others. For example, the substituted dibenzothiophenes are less amenable to hydrodesulfurization than dibenzothiophene itself and this effect varies according to the extent and type of substitution in the dibenzothiophenes. See History of Catalytic Processes, Gates et al. McGraw Hill, pages 406 and 407. This observation is confirmed by laboratory experience which shows that hydrodesulfurization of full range LCO (about 700° F. end point) requires high severity conditions for achieving low sulfur levels comparable to the proposed 0.05 weight percent. These difficulties are, moreover, accentuated by the fact that the other sulfur- and nitrogen-containing impurities in the feed react earlier in the reactor, producing ammonia and hydrogen sulfide, which further inhibit the removal of the dibenzthiophenes.

In addition, converting the dibenzothiophenes requires high hydrogen partial pressures and circulation rates, low space velocity and high temperature, implying a significant increase in the capacity of the hydrogen circulation system, an increase in the reactor bed size, an increase in operating pressure, a decrease in cycle length or any combination of these. The higher severity operation can also increase cracking and, therefore, light gas production.

SUMMARY OF THE INVENTION

We have now devised a processing scheme which enables low sulfur distillate fuels including road diesel oils to be produced in a manner which minimizes hydrogen consumption and which alleviates the difficulties mentioned above. The process is based upon the amenabil ity of the lighter fractions of distillate feeds to hydrodesulfurization under relatively mild conditions.

According to the present process, a low sulfur distillate fuel oil product is produced from two distillate boiling range feeds of differing dibenzothiophene contents by subjecting the feed of higher dibenzothiophene content to hydrodesulfurization using a fresh hydrogen feed i.e. which is essentially free of inorganic sulfur and nitrogen contaminants, to form a low sulfur, distillate fraction. This low sulfur distillate fraction is then combined with the feed of low dibenzothiophene content and the combined fractions subjected to hydrodesulfurization, preferably under less severe conditions, to form the hydrotreated, low sulfur distillate fuel oil product.

The feeds may be separated according to dibenzothiophene content by membrane separation but the preferred method is by fractionation; lower boiling fractions will contain less of the refractory dibenzothiophenes which tend to concentrate in the higher boiing fractions. In the preferred form of the process, therefore, a distillate feed, for example, a light cycle oil from a catalytic cracking process, typically having an end point of about 700° F. (about 370° C.),is fractionated into a first, lower boiling fraction and a second fraction which is of higher boiling range relative to the first. The end point of the first fraction is selected so that it is substantially free of dibenzothiophenes. To this end, the 99 percent point of this fraction is normally selected to be in the range of about 520° to 590° F. (about 270° to 310° C.), usually about 530° to 570° F. (275° to 300° C.). The second, higher boiling fraction, which contains the dibenzothiophenes from the feed is cut at a point so that it has an initial point preferably no lower than the 95 percent point of the lower boiling fraction.

The higher boiling fraction, optionally with another fraction containing dibenzothiophenes, is hydrodesulfurized under high severity conditions, to form the high boiling portion of the final desulfurized fuel. This desulfurized component is then combined with the lower boiling fraction of the feed and optionally, another lower boiling fraction such as a virgin kerosene, and desulfurized under relatively mild conditions. Thus, the two desulfurization steps are carried out in serially connected hydrodesulfurization zones, with the high boiling fraction and hydrogen passing through both zones in series, to achieve the greatest feasible degree of desulfurization.

DRAWINGS

The single figure of the accompanying drawings is a process schematic illustrating the present process.

DETAILED DESCRIPTION

Distillate fractions which may be used in the present process include, for example, light gas oils, heavy gas oils, cycle oils from catalytic cracking processes, including light cycle oils, heavy cycle oils and full range cycle oils, as well as other refinery distillate streams requiring desulfurization, for example, kerosene, straight run gas oils and coker light gas oil (CLGO) and mixtures of feed such as these. Feeds such as these are classified as distillates and typically have an initial point of at least 330° F. (about 165° C.) and usually of at least 400° F. (about 205° C.). Feed end points will normally not exceed about 1050° F. (about 565° C.) and usually will be no more than about 850° F. (about 455° C.) for distillate fuel oil products. For products such as road diesel oil, the end point of the feed will normally be limited to about 800° F. (about 425° C.). The light cycle oil fraction from an FCCU, to take an example of one particular feed, typically boils in the range of about 390° to 750° F., usually 700° F., for a full range LCO but narrower cut points may be selected depending upon the configuration of the main column product draw locations. Here, cut points of 390° and 700° F. correspond to a full range LCO with a separation between the lighter fraction and the heavier fraction at 570° F. (about 300° C.).

The figure shows a process flow diagram for the present integrated processing scheme. A distillate feed, for example, from a fluid catalytic cracking unit (FCCU) enters HDS unit prefractionator 10 through line 11. As an alternative to the prefractionator shown, the desired distillate fractions may be provided directly from the FCC main column.

The fractionator bottoms fraction is taken through line 12 through furnace 13 and enters high severity hydrodesulfurization (HDS) reactor 14 together with hydrogen from line 15. This fraction, to which additional feed of high dibenzothiophene content may be added through line 16, is subjected to high severity hydrode.sulfurization in this reactor, to convert the dibenzothiophenes to inorganic form, together with other sulfur compounds in this portion of the feed.

The lighter overhead fraction from column 11 is taken to low severity HDS reactor 20 after passing through heat exchanger 21 where it provides quench for the reactor effluent, entering by way of line 22 in which it is joined with the effluent from the high severity reactor 14. Additional feedstreams of low dibenzothiophene content, such as virgin kerosene, may be added thorugh line 17. The combined fractions then pass through low severity reactor 20 in which the less refractory sulfur and nitrogen compounds are converted to inorganic form ($H_2S$, $NH_3$). In order to provide the desired space velocity in this reactor for the larger volume of feed, the bed size of the low severity reactor will be related to that of the high severity reactor by a factor corresponding to the ratio of the total feed to the bottoms fraction and the ratio of the space velocities in the two reactors.

The effluent from the low severity reactor, containing the combined hydrodesulfurized fractions, then passes to heat exchanger 21 to provide heat for the entering light fraction before entering product recovery section 23 in which contaminants, light gases and lower boiling fractions are removed from the desired low sulfur distillate fuel oil which is recovered from line 24. A low sulfur naphtha may be recovered from line 25 for blending into the refinery gasoline pool. Hydrogen is recirculated through recycle loop 26, with purge from outlet 27 and fresh make-up hydrogen provided by way of line 28. Recycle compressor 29 brings the pressure up to the level desired for the high severity hydrotreater.

The separation of the two fractions is made at a cut point of about 605° F. because temperatures in this range coincide closely with the point at which the sulfur-containing compounds in the feed become increasingly refractory to removal by hydrogenative techniques.

The lighter fraction of the feed is amenable to desulfurization under relatively milder conditions since the sulfur-bearing compounds in it are those which are readily desulfurized in an HDS unit operating under lower severity conditions, for example, relatively low hydrogen pressures, typically 400 to 1000 psig (about 2860 to 7000 kPaa) which permit the less refractory sulfur compounds to be converted, for example, aliphatic sulfur, thiophene, dibenzothiophene and other compounds in which steric hydrance is minimized. See Gates et al. op cit. The heavier fraction, usually boiling above about 605° F. contains a higher proportion of the refractory dibenzothiophenes which require high severity hydrotreating in order to be desulfurized.

The low severity HDS unit operating under the relatively mild conditions sufficient to convert the less refractory sulfur compounds uses a HDS catalyst such as Co-Mo on alumina or another conventional hydrodesulfurization catalyst. Typical conditions for this reactor are set out in Table 1 below:

TABLE 1

| LOW SEVERITY HDS OPERATING CONDITIONS | |
|---|---|
| Hydrogen Partial Pressure | 400–1000 psig |
| LHSV, $hr^{-1}$ | 1.5–3.0 |
| Hydrogen Circulation, SCF/Bbl | 800–1500 |
| Hydrogen Consumption, SCF/Bbl | 300–500 |
| Reactor Temperature, °F. | 600–750 |
| Desulfurization, pct. | 85+ |

The high severity HDS reactor is run under relatively more severe conditions with high hydrogen circulation and usually with a higher temperature and lower space velocity. A more active catalyst may also be used, for example, Ni-W or Ni-Mo on alumina. Although higher hydrogen pressures, for example, above 800 psig (about 5620 kPaa) and preferably from 1,000 to 1,500 psig (about 7000 to 10445 kPaa), with a correspondingly higher hydrogen consumption of at least 1,000 SCF/Bbl (about 178 n.l.l.$^{-1}$), would be preferred for this stage of the operation, the direct cascade into the lower severity reactor will normally necessitate operation of both reactors at essentially the same pressure to avoid the higher recompression costs associated with the pressure let down between the two reaction stages. Because, however, the space velocity of feed is lower in the high severity reactor, the hydrogen circulation rate will be higher in this reactor as will the hydrogen consumption per barrel of feed, mainly as a result of the higher temperatures prevailing in this reactor, with their greater potential for ring opening reactions. If higher hydrogen circulation rates and hydrogen oil ratios are required in the low severity reactor, additional hydrogen may be added through line 30 although it is preferred to pass all the hydrogen through the first reactor to maximize hydrodesulfurization in this reactor.

Typical conditions for the high severity reacor are described in Table 2.

TABLE 2

| HIGH SEVERITY HDS OPERATING CONDITIONS | |
|---|---|
| Hydrogen Partial Pressure, psig | 400–1000 |
| LSHV, $hr^{-1}$ | 1.0 |
| Hydrogen Circulation, SCF/Bbl | 2000–10000 |
| Hydrogen Consumption, SCF/Bbl | 600+ |
| Reactor Temperature, °F. | 650–800 |
| Desulfurization, pct | 90+ |
| Denitrogenation, pct | 85+ |

The process may be carried out in more than the two reactors shown, for example with three reactors in series divided between the feed fractions to provide the required degrees of operating severity. Separate regeneration circuits including swing reactors, may be provided for the high and low severity reactors, especially since the cycle life of the high severity reactor may be shorter than that of the low severity reactor. An additional fired furnace may also be provided to provide additional flexibiltiy by preheating the lighter feed containing the lower amount of dibenzothiophenes. As an alternative to the distillative separation of the high and low-dibenzothiophene fractions, membrane separation may also be utilized.

The advantage of the present process is that the desulfurization of the refractory dibenzothiophenes in the first reactor is facilitated by the fresh hydrogen, essentially free of ammonia and hydrogen sulfide. The second reactor is able to deal with the remaining sulfur compounds at a reactor temperature which is lower than it would be for a single reactor system. The total catalyst requirement may also be lower as a result of the differing space velocities in the two reactors, with the majority of the feed entering the second reactor.

We claim:

1. A process for producing a low sulfur distillate fuel oil product from two distillate boiling range feeds produced by the fractionation of a distillate feed into a high boiling fraction of high dibenzothiophene content which boils above about 605° F. and a lower boiling fraction which is of low dibenzothiophene content relative to the high boiling fraction and which boils below about 605° F., which comprises:

(1) subjecting the feed of higher dibenzothiophene content to hydrodesulfurization under a first set of hydrodesulfurization conditions including a hydrogen pressure of 400 to 1000 psig, a hydrogen circulation rate of 2,000 to 10,000 SC.F/Bbl and a temperature of 650° to 800° F. to form a low sulfur, distillate fraction, (2) combining the low sulfur distillate fraction with the feed of low dibenzothiophene content, (3) subjecting the combined low sulfur fraction and the feed of low dibenzothiophene content to hydrodesulfurization under a second set of hydrodesulfurization conditions including a temperature of 600° to 750° F., a hydrogen pressure of 400–1,000 psig and a hydrogen circulation rate of 800–1500 SCF/Bbl, to form a hydrotreated, low sulfur distillate fuel oil product.

2. A process according to claim 1 in which the high dibenzothiophene fraction is hydrodesulfurized under conditions in which the hydrogen circulation rate is more than 2,000 SCF/Bbl.

3. A process according to claim 1 in which the low dibenzothiophene fraction is hydrodesulfurized under conditions in which the hydrogen consumption is less than 1,000 SCF/Bbl $H_2$.

4. A process according to claim 1 in which the low sulfur distillate product has sulfur content of not more than 0.1 weight percent.

5. A process according to claim 2 in which the low sulfur distillate product has a sulfur content of not more than 0.05 weight percent.

6. A process for producing a low sulfur distillate fuel oil product from a distillate boiling range feed, which comprises:

(1) fractionating the feed to form (i) a first, relatively low boiling fraction having a boiling range in the range of 390° to about 605° F. and a low content of dibenzothiophenes, and (ii) a second, relatively high boiling fraction having a boiling range in the range of about 605° to 850° F., and a high content of dibenzothiophenes relative to the first fraction, (2) subjecting the relatively higher boiling feed to hydrodesulfurization under a first set of hydrodesulfurization conditions of elevated temperature and pressure including a hydrogen pressure of 400 to 1000 psig, a hydrogen circulation rate of 2,000 to 10,000 SCF/Bbl and a temperature of 650° to 800° F., to form a low sulfur, relatively high boiling distillate fraction, (3) combining the low sulfur, relatively high boiling distillate fraction with the relatively low boiling fraction, (4) hydrotreating the combined low sulfur, relatively higher boiling fraction and the lower boiling fraction to hydrodesulfurization under a second set of hydrodesulfurization conditons including a temperature of 600° to 750° F., a hydrogen pressure of 400–1,000 psig and a hydrogen circulation rate of 800–1500 SCF/Bbl, to form the hydrotreated product.

7. A process according to claim 6 in which the relatively lower boiling fraction is hydrodesulfurized under conditions in which the hydrogen consumption is less than 1,000 SCF/Bbl $H_2$.

* * * * *